United States Patent [19]

Connell

[11] 3,992,914

[45] Nov. 23, 1976

[54] ROLLING OPERATIONS

[75] Inventor: Gordon Sidney Connell, Cheltenham, England

[73] Assignee: Formflo Limited, Cheltenham, England

[22] Filed: July 21, 1975

[21] Appl. No.: 597,738

[30] Foreign Application Priority Data

July 24, 1974 United Kingdom ..... 32785/74

[52] U.S. Cl. ..... 72/106; 72/22; 72/110

[51] Int. Cl.[2] ..... B21H 1/12

[58] Field of Search ..... 72/7, 22, 23, 102, 105, 72/106, 107, 108, 110; 29/148.4 R

[56] References Cited

UNITED STATES PATENTS 2,776,585 1/1957 Kendall ..... 72/23

3,803,890 4/1974 Connell ..... 72/107

*Primary Examiner*—Lowell A. Larson

*Attorney, Agent, or Firm*—Pollock, Vande Sande & Priddy

[57] ABSTRACT

A method of forming to shape an initially annular workpiece in which the workpiece is rotated and squeezed between a pair of opposed forming rolls at least one of which is advanced relatively towards another. A pair of opposed growth control rolls are situated at right angles to the forming rolls, contacting the outer surface of the workpiece during at least a part of the rolling by the forming rolls. When the forming rolls have advanced to a predetermined depth of roll the force exerted by the growth control rolls on the outer surface of the workpiece is increased and the rolls continue to move towards one another until an adjustable dead stop is reached.

2 Claims, 4 Drawing Figures

ROLLING OPERATIONS

This invention relates to improvements in rolling operation, particularly those described in U.S. Pat. Nos. 3,803,890 amd 3,839,892.

On certain inner bearing rings having external forms produced by rolling and which are not subjected to further machining operations after hardening, it has been found necessary to place the diametral control emphasis more on the outer diameter of the bearing rings.

In order to achieve this type of control there is provided according to the invention a method of forming to shape an initially annular workpiece in which the workpiece is rotated and squeezed between a pair of opposed forming rolls as they advance relatively to one another and a pair of opposed growth control rolls, at right angles to the forming rolls, contacting the outer surface of the workpiece during at least a part of the rolling by the forming rolls, wherein when the forming rolls have advanced to a predetermined depth of roll the force exerted by the growth control rolls on the outer surface of the workpiece is increased and the rolls continue to move towards one another until an adjustable dead stop is reached.

The main advantage of this method is that the rolled dimensions of the ring can be controlled accurately.

The rolling apparatus is similar to that described in U.S. Pat. Nos. 3,803,890 and 3,829,892.

The blank is located on a mandrel, which is preferably a split mandrel (described in copending Ser. No. 597,740 filed July 21, 1975 and the growth control rolls made to rest on the blank. At this point in the rolling cycle the force exerted by the growth control rolls is approximately 200 to 500 lbf. This force is maintained during rolling until the forming rolls have reached a preset position at which point the ring being rolled starts to increase rapidly in diameter.

The force exerted by the growth control rolls is then increased substantially to a preset figure to contain this diametral growth, and these rolls continue to move towards one another until the adjustable dead stop is reached.

The pressure change over point is always a constant distance from the full depth final roll position, for a given size and type of ring. The force varies with the type and size of ring rolled. The change in force is smoothly applied, using for example a hydraulic accumulator because if this higher force is applied too suddenly the traction applied by the forming rolls is lost, resulting in severe metal pick-up on these rolls. If applied too late, the ring will have increased substantially in diameter preventing accurate size control and increasing the possibility of fatigue and fracture.

When the forming rolls are fully advanced, the depth of roll being controlled by an adjustable stop or variable stop as described in U.S. Pat. No. 3,839,892, the growth control rolls move towards each other and in so doing diametrically shrink the ring. When a preset gap between the growth control rolls is reached the hydraulic pressure is maintained during the first dwell, thereby holding the stop nuts against the stop face. The ring is now at the correct diameter and a second dwell time is used to improve the roundness of the rolled ring. During this second dwell period the growth control roll valve is controlled to create hydraulic lock. Both growth control rolls valve and the forming rolls are then retracted and the ring removed from the mandrel.

The invention will be further described by way of example and with reference to the accompanying drawings.

DESCRIPTION OF PREFERRED EMBODIMENTS

Figure 1:
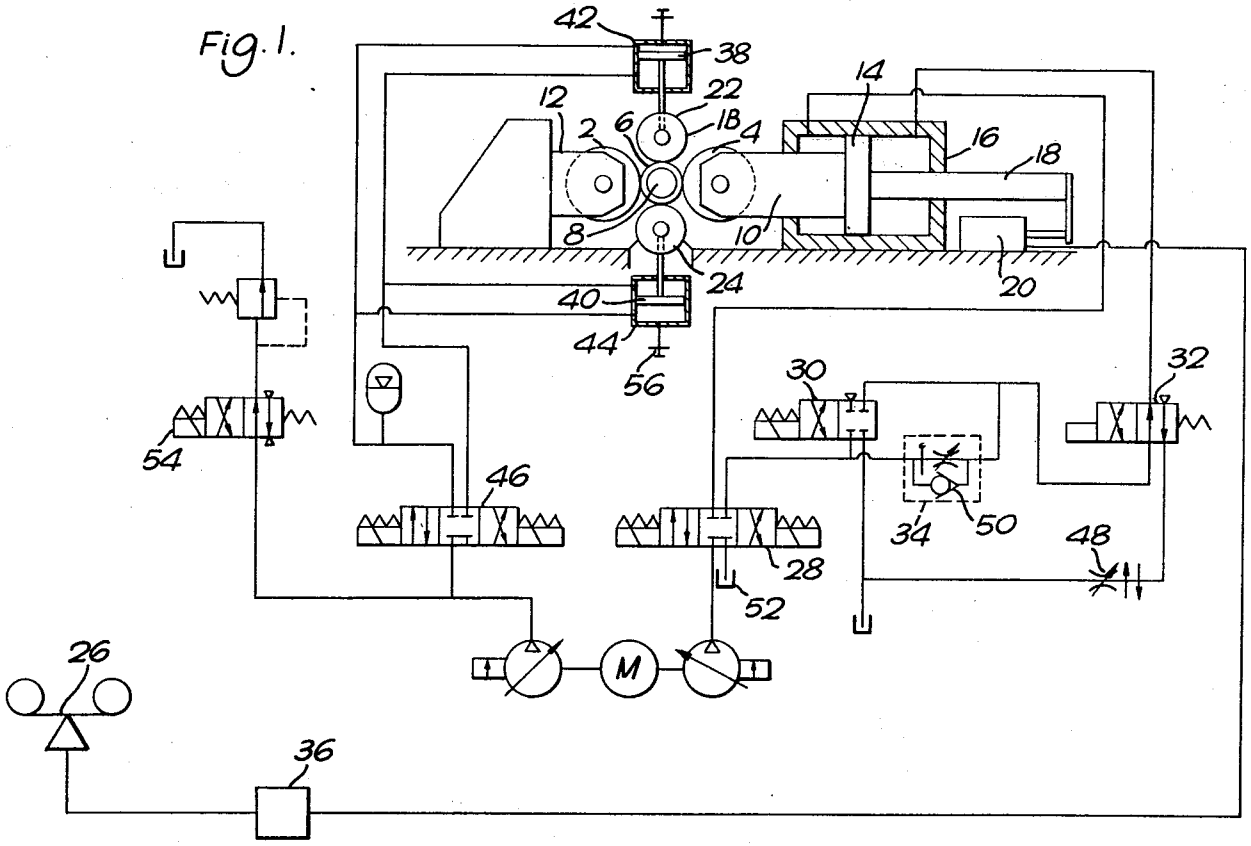
FIG. 1 shows a side view of a rolling machine for rolling a profile into the outer surface of an annular workpiece, together with a hydraulic circuit for operating the machine.

Regarding FIG. 1, the rolling machine has two opposed forming rolls 2 and 4, between which is supported an annular workpiece 6 on a mandrel 8. The mandrel can be, for example, a split mandrel as described in our copending application Ser. No. 597,740, filed July 21, 1975. In the embodiment shown in FIG. 1 only the right hand roll 4 can be moved horizontally towards and away from the workpiece 6 but a rolling machine having both forming rolls movable can be used. This would involve only a simple change in the hydraulic circuitry. Both forming rolls 2 and 4 are each supported in a respective yoke 10 and 12. Yoke 10 is afixed but yoke 12 is connected to a piston 14 which is movable inside a cylinder 16. The piston is in turn connected by means of a piston rod 18 to a digital or analogue transducer 20.

At right angles to the forming rolls 2 and 4 are two opposed growth control rolls 22 and 24 and reducing any ovality in the workpiece 6 produced by the forming rolls 2 and 4 during rolling. The growth control rolls are rotatably supported by any suitable means such as that described in U.S. Pat. No. 3,803,890.

Prior to the rolling operation the annular workpiece 6 to be rolled is weighed in a weighing unit 26. The difference in weight between the workpiece 6 under consideration and a nominally sized workpiece produces a digital or analogue output signal during rolling. After weighing the workpiece 6 is inserted in the rolling machine ready for the start of the rolling operation.

To advance the forming roll 4, hydraulic fluid is passed to a change over valve 28, which is set in the position which allows fluid to be conveyed to the back of the piston 14 to advance the roll 4. From the changeover valve 28 the hydraulic fluid passes via two other changeover valves 30 and 32 to the back of piston 14 which is thereby made to advance under the pressure of the fluid. The initial advancement of the forming roll 4 is relatively fast, but when the forming roll 4 is nearly in contact with the workpiece 6 its speed of advancement is slowed down by switching the changeover valve 30 so that the hydraulic fluid passes through a flow control valve 34.

As the forming roll 4 advances its movement is converted, by the transducer 20 to a signal, such as a voltage, which is compatible with that produced by the weighing unit 26, and these two signals are compared in a factoring unit 36. When the signals from the transducer 20 and the weighing unit 26 correspond the factoring unit 36 switches the changeover valve 28 to prevent hydraulic fluid continuing to flow to the back of piston 12.

When the forming roll 4 is fully advanced it remains in the advanced position for a period of time known as the dwell time. The extent of advancement of the forming roll 4 or the dwell time depends on the difference between the weight of the workpiece being rolled and the weight of a nominally sized workpiece.

As mentioned above the rolling machine also includes a pair of growth control rolls 22 and 24. Each growth control roll 22 and 24 is connected to a respective piston 38 and 40 which is movable inside a cylinder 42 and 44. During rolling hydraulic fluid is supplied to the back of the pistons 38 and 40 via a changeover valve 46. This allows the pistons 38 and 40 to advance as the form is produced in the workpiece, keeping the growth control rolls 22 and 24 in contact with the workpiece 6 with sufficient force to prevent the workpiece from distorting to any large extent.

When the forming roll 4 reaches a predetermined depth of roll the force exerted by the growth control rolls is increased as hereinafter described. After the completion of the dwell time change over 28 is switched so that hydraulic fluid can pass to the front of piston 14 thereby causing the forming roll 4 to retract. The retraction of the forming roll 4 in turn causes hydraulic fluid to flow to changeover valve 32 which is now set so that fluid passes through a slow-back off control valve 48. This control valve 48 limits the speed with which the forming roll can retract. The roll is initially retracted slowly to prevent any distortion in the shape of the rolled workpiece which could occur if the forming rolls 4 was retracted too fast. After the forming roll 4 has been retracted a predetermined distance its speed of retraction can safely be increased. This is effected by switching the changeover valve 32 so that hydraulic fluid flows through check valve 50 then back to a hydraulic fluid reservoir 52 via changeover valve 28.

Figure 2:
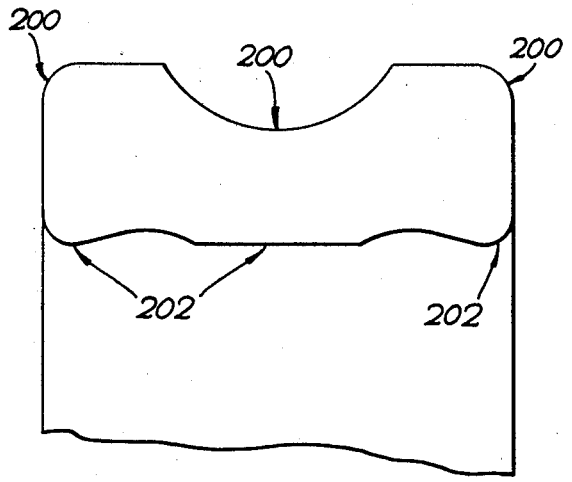
FIG. 2 shows the effect of 'bore ripple' in rolled rings.

FIG. 2 shows a section of a bearing ring. The maximum forming force is generated at the formed region, indicated by numeral 200. As a result a corresponding deformation is produced at the region 202. This deformation may only be a few thousandths of an inch but its effect is far from negligible. By using the method according to the invention this 'bore ripple' phenomenon can be reduced and sometimes even eliminated.

As mentioned above, when the forming rolls reach the required depth of roll the force exerted by the growth control rolls 22 and 24 is increased. This is effected by means of valve 54. The growth control rolls 22 and 24 are held against the dead stops 56 by hydraulic pressure created by valve 46 remaining open during the first dwell period. The dead stops 56 ensure that a constant gap is maintained for each ring rolled.

Additionally, by adjusting the position of these dead stops 56 a change in ring size can be effected should this be required due to after changes in the ring manufacturing process. When this invention is used in parallel with the inventions described in U.S. Pat. No. 3,839,892 and co-pending Patent Application No. 597,739, filed July 21, 1975 an extremely effective form ring size control is apparent as shown in FIG. 3.

Figure 3:
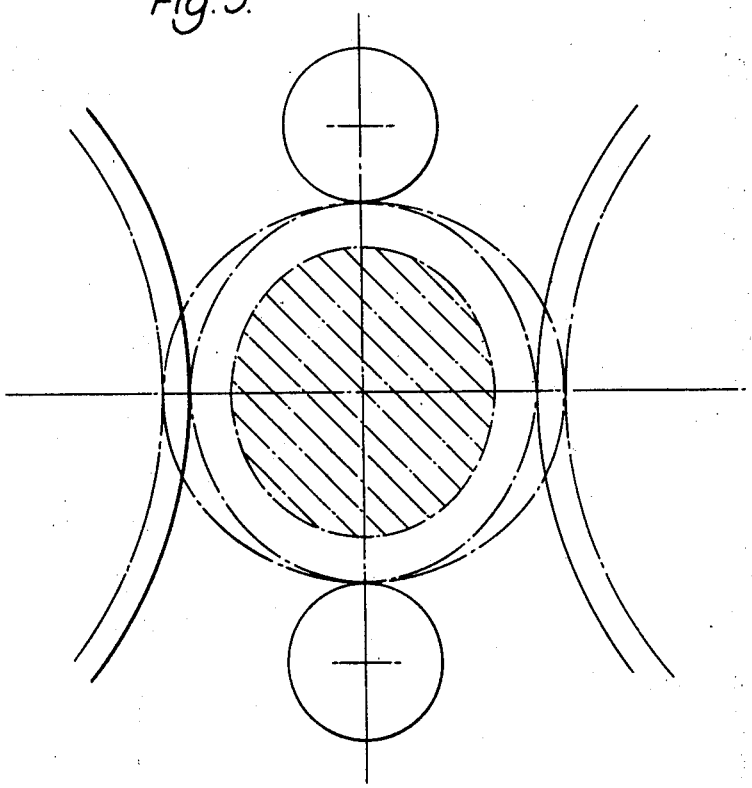
FIG. 3 shows in cross section part of a rolling machine illustrating the fixed adjustable stops on the growth control rolls.

FIG. 3 shows the part of the rolling cycle at which the final size is reached (and of the first dwell) and prior to 'rounding up'.

The size control accuracy is achieved by constant control of the outside diameter in the growth control roll axis and constant control of the bore in the case of the main forming roll axis. The opposite elements i.e. bore and outside diameter respectively being varied according to the volume of the ring.

This system is found to give better accuracy than the previous, pressure only system.

Figure 4:
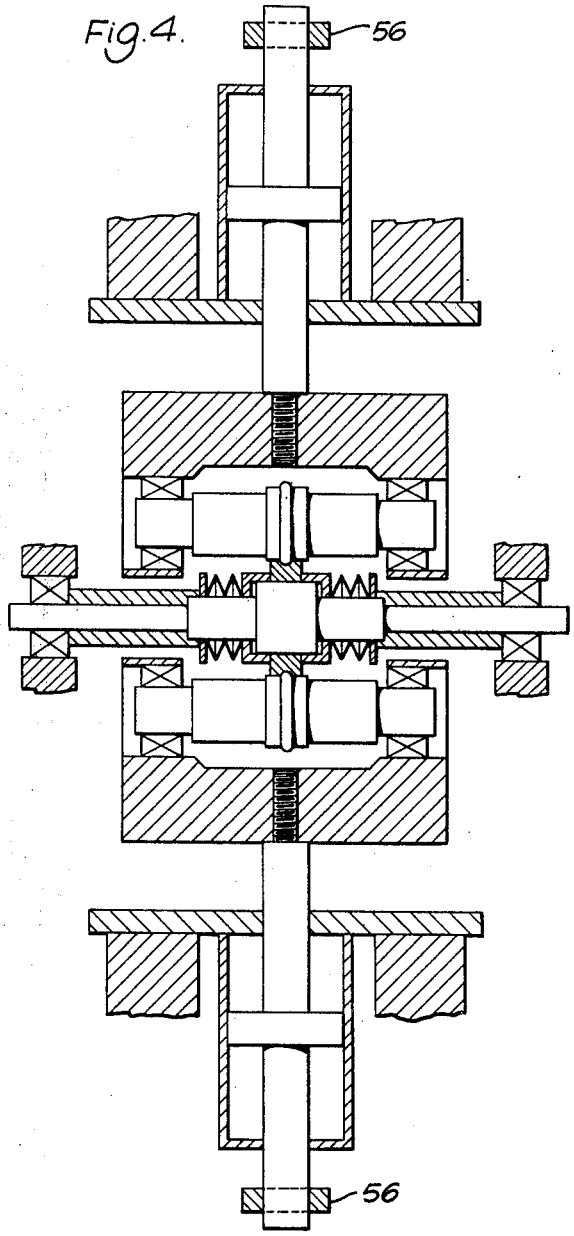
FIG. 4 shows part of the rolling cycle at which the final ring size is reached.

FIG. 4 shows in cross section part of a rolling machine illustrating the fixed adjustable stops 56 on the growth control rolls. This rolling machine is fully described in U.S. Pat. No. 3,803,890.

What is claimed is:

1. A method of roll forming an inner bearing ring from an annular workpiece in a rolling machine having a mandrel for supporting said workpiece, two oppositely disposed forming rolls, one on each side of the mandrel, two oppositely disposed growth control rolls, one on each side of the mandrel, at right angles to said forming rolls, said forming rolls being capable of advancing relative to one another to roll form said workpiece and retracting, said growth control rolls being capable of advancing towards one another and retracting, said method comprising the steps of:

a. advancing the forming rolls relative to one another until a predetermined depth of roll is reached, b. advancing said growth control rolls towards one another, said growth control rolls contacting said workpiece and exerting a relatively low force on said workpiece until said forming rolls reach said predetermined depth of roll, c. thereafter increasing the force exerted by said growth control rolls on said workpiece and allowing said growth control rolls to advance towards each other under said increased force to diametrically shrink said workpiece until a predetermined extent of advancement is reached, and then d. retracting said growth control rolls and said forming rolls.

2. A method as claimed in claim 1 in which the extent to which said growth control rolls can advance is determined by adjustable dead stops.

* * * * *